US010651571B2

(12) United States Patent
Wu et al.

(10) Patent No.: US 10,651,571 B2
(45) Date of Patent: May 12, 2020

(54) METAL LEAF SPRING PROTECTION STRUCTURE OF ELECTRICAL CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chang Han Lee, New Taipei (TW)

(73) Assignees: SWITCHLAB INC., New Taipei (TW); SWITCHLAB (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 15/987,193

(22) Filed: May 23, 2018

(65) Prior Publication Data

US 2018/0342816 A1 Nov. 29, 2018

(30) Foreign Application Priority Data

May 26, 2017 (TW) ..... 106207569 U

(51) Int. Cl.
*H01R 4/48* (2006.01)
*H01R 12/51* (2011.01)

(52) U.S. Cl.
CPC ..... *H01R 4/4818* (2013.01); *H01R 4/4827* (2013.01); *H01R 4/4845* (2013.01); *H01R 12/515* (2013.01)

(58) Field of Classification Search
CPC ..... H01R 4/48; H01R 4/4809; H01R 4/4836; H01R 4/4818; H01R 4/4827;
(Continued)

(56) References Cited

U.S. PATENT DOCUMENTS 4,824,395 A * 4/1989 Blaha ..... H01R 4/4818 439/438
5,098,316 A * 3/1992 Kollmann ..... H01R 4/4818 439/441
(Continued)

FOREIGN PATENT DOCUMENTS

DE 3346027 A1 * 7/1985 ..... H01R 4/4818
DE 4003701 A1 * 8/1991 ..... H01R 4/4818
(Continued)

OTHER PUBLICATIONS

Translation DE202014101915 (Year: 2015).*

*Primary Examiner* — Edwin A. Leon
*Assistant Examiner* — Milagros Jeancharles
(74) *Attorney, Agent, or Firm* — Rosenberg, Klein & Lee

(57) ABSTRACT

A metal leaf spring protection structure of electrical connection terminal includes a main body having a base section defined with a first end and a second end. The first end is connected with a first section and a locating section. The second end is connected with a bight section and a second section. The locating section has a head section and a tail section. The tail section extends to a position of the bight section to form a hook-like structure for providing an elastic action force and a support system. The locating section is positioned in the reciprocally moving path of the second section to set up a moving end point of the second section to improve the shortcomings of the conventional metal leaf spring that when plugging in the conductive wire, the metal leaf spring is over-bent to affect the pressing and securing effect.

33 Claims, 12 Drawing Sheets

(58) Field of Classification Search
CPC .. H01R 4/4845; H01R 4/4854; H01R 13/113; H01R 12/515
See application file for complete search history.

(56) References Cited

U.S. PATENT DOCUMENTS 5,454,730 A * 10/1995 Tozuka ..... H01R 4/4818 439/438
5,938,484 A * 8/1999 Beege ..... H01R 4/4845 439/828
6,126,496 A * 10/2000 Shinozaki ..... H01R 13/7033 439/862
6,155,890 A * 12/2000 Gerberding ..... H01R 4/4845 439/835
6,538,197 B1 * 3/2003 Kawai ..... H01R 12/515 174/363
6,776,670 B2 * 8/2004 Suss ..... H01R 4/4818 439/834
6,827,614 B2 * 12/2004 Bechaz ..... H01R 4/4845 439/828
7,101,231 B2 * 9/2006 Prokup ..... H01R 4/4809 439/709
7,704,106 B2 * 4/2010 Koellmann ..... H01R 4/4845 439/834
8,485,841 B2 * 7/2013 Schrader ..... H01R 4/4827 439/441
10,141,661 B2 * 11/2018 Ahldag ..... H01R 4/4818
2003/0057621 A1 * 3/2003 Pedrinelli ..... H01R 4/4845 267/154
2012/0289098 A1 * 11/2012 Stjepanovic ..... H01R 4/4818 439/822
2015/0357727 A1 * 12/2015 Gassauer ..... H01R 4/4836 439/751
2016/0248174 A1 * 8/2016 Ludewig ..... H01R 4/4827
2018/0331449 A1 * 11/2018 Juelich ..... H01R 4/4836

FOREIGN PATENT DOCUMENTS

DE 202014101915 U1 * 7/2015 ..... H01R 4/4827
EP 1672740 A1 * 6/2006 ..... H01R 4/4836

* cited by examiner

METAL LEAF SPRING PROTECTION STRUCTURE OF ELECTRICAL CONNECTION TERMINAL

BACKGROUND OF THE INVENTION

1. Field of the Invention

The present invention relates generally to a metal leaf spring protection structure of electrical connection terminal, and more particularly to an assembly of a terminal device for an electro-conductive wire to plug in and connect therewith and a metal leaf spring for pressing or releasing the electro-conductive wire.

2. Description of the Related Art

A conventional terminal device or wire pressing terminal has an insulation case (generally made of plastic material) and an electrical connector or metal member (or metal leaf spring). The metal leaf spring is enclosed in the insulation case to press and electrically connect with or release a conductive wire plugged into the terminal device.

Such electrical connection terminal devices include two types. The first type of electrical connection terminal device is inserted on a circuit board such as printed circuit board (PCB). The second type of electrical connection terminal device is latched with a grounding rail (or conductive rail) in a row to set up a common grounding device of an electrical apparatus or mechanical equipment.

The aforesaid electrical connection terminal is inserted on a circuit board such as printed circuit board (PCB) or a grounding rail and includes an insulation case having a perforation or a wire plug-in hole for the conductive wire to plug into the interior of the case. The case defines a chamber in which the electrical connector (or the metal leaf spring) is mounted. The metal leaf spring serves to contact or electrically connect with the conductive wire plugged into the case. The electrical connector has an elastic free end. After the conductive wire is plugged into the case, the free end of the electrical connector will bite the conductive wire to prevent the conductive wire from easily detaching from the electrical connector out of contact with the electrical connector. Unless an operator uses a tool to extend into the case and push/press the free end, the conductive wire cannot be released from the contact of the electrical connector.

The metal leaf spring of the conventional electrical connection terminal device has some shortcomings in structural design and application. For example, when plugging the conductive wire into the terminal device, due to human operation factor, it often takes place that the conductive wire cannot enter the terminal device by a precise angle to push/press the free end of the metal leaf spring. In this case, the elastic free end of the metal leaf spring can hardly securely press and restrict the conductive wire or the metal leaf spring will be over-bent. Especially, after a long period of high-frequency assembling operation of the conductive wire, elastic fatigue is apt to happen to the structure of the metal leaf spring. As a result, the lifetime of the terminal device will be shortened.

In order to improve the shortcoming of the metal leaf spring that elastic fatigue is apt to happen to the structure of the metal leaf spring to shorten the lifetime of the terminal device, a technical means for preventing the metal leaf spring from being over-bent has been disclosed.

The conventional clamping spring (or metal leaf spring) is assembled with a reception member (or frame body). A protrusion section is formed on one side of the reception member in the moving path of the clamping leg (or free end) of the clamping spring to prevent the clamping leg from being over-biased.

However, as well known by those who are skilled in this field, the structure of the additional protrusion section of the reception member (or frame body) in cooperation with the clamping spring (or metal leaf spring) is relatively complicated. In addition, when the conductive wire is plugged into the electrical connection terminal by an imprecise angle, the conductive wire also will push/press the clamping leg of the clamping spring to deflect the clamping leg and make the clamping leg pass over the protrusion section. This deteriorates the effect that the protrusion section prevents the clamping leg from being over-biased. This is not what we expect.

To speak representatively, the above references reveal some shortcomings existing in the conventional electrical connection terminal and the metal leaf spring in design of relevant assembling structure. In case the assembling structure of the terminal device and the metal leaf spring is redesigned to be different from the conventional electrical connection terminal, the use form of the electrical connection terminal can be changed to practically improve the application of the electrical connection terminal and enhance the operation stability of the electrical connection terminal.

It is found that the structural form of an optimal terminal device or metal leaf spring must overcome or improve the aforesaid shortcomings of the conventional electrical connection terminal and include several design considerations as follows:

1. The structural form of the conventional electrical connection terminal that the reception member (or frame body) is additionally formed with the protrusion section must be omitted so as to improve the shortcomings existing in the conventional electrical connection terminal that the cooperative structure is relatively complicated (and/or the manufacturing cost is relatively high) and the clamping leg (or the free end of the metal leaf spring) is apt to deflect and pass over the protrusion section to deteriorate the effect that the protrusion section prevents the clamping leg from being over-biased.
2. In the condition that the metal leaf spring can keep stably pressing and restricting the conductive wire, a true moving range of the metal leaf spring (or the free end thereof) is set up. Especially, the metal leaf spring itself forms an end position, whereby the free end can only move to reach the set end position, that is, the metal leaf spring itself can stop the free end. Therefore, no matter how the free end moves, the free end cannot pass over the metal leaf spring so that the free end is prevented from being over-biased. In this case, the possibility that the metal leaf spring is over-bent to shorten the lifetime of the electrical connection terminal as in the conventional structure is minimized.
3. A support system is provided as a metal leaf spring protection structure, which has an elastic action force to help the metal leaf spring to securely press and restrict the conductive wire and prevent the metal leaf spring from being over-biased.

SUMMARY OF THE INVENTION

It is therefore a primary object of the present invention to provide a metal leaf spring protection structure of electrical connection terminal. The metal leaf spring protection structure includes a main body. The main body has a base section defined with a first end and a second end. The first end is connected with a first section and a locating section. The second end is connected with a bight section and a reciprocally movable second section. The locating section has a head section and a tail section. The tail section extends to a position of the bight section to form a hook-like structure and has an elastic action force as a support system. The locating section is positioned in the reciprocally moving path of the second section to set up a moving end point of the second section. The metal leaf spring protection structure of electrical connection terminal improves the shortcomings of the conventional metal leaf spring that the conductive wire cannot be plugged into the terminal by a precise angle so that the metal leaf spring is over-bent to affect the pressing and securing effect.

In the above metal leaf spring protection structure of electrical connection terminal, a bent section is formed between the first end of the base section and the first section. The bent section contains an angle. The first section is bent toward the second end of the base section and obliquely extends to connect with the locating section, whereby a subsidiary bent section is formed between the first section and the locating section. The subsidiary bent section contains an angle. The bight section between the second end and the second section of the base section contains an angle, whereby the second section obliquely extends in a direction to the first end of the base section. The tail section is bent along the curvature of the bight section to form the hook-like structure. When the second section moves forward to contact or push/press the locating section or the hook-like structure, the hook-like structure supports the bight section to provide an elastic action force for helping the second section to move backward toward the initial position.

Accordingly, the second section is prevented from being over-biased.

The present invention can be best understood through the following description and accompanying drawings, wherein:

DETAILED DESCRIPTION OF THE PREFERRED EMBODIMENTS

Figure 2:
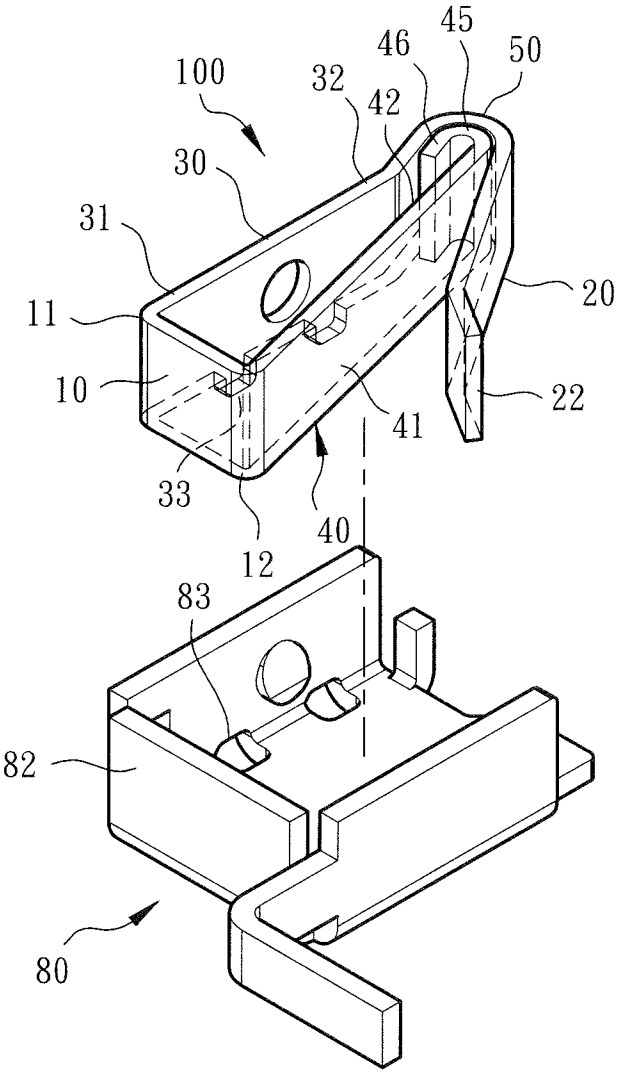
FIG. 2 is a perspective exploded view according to FIG. 1.
Figure 1:
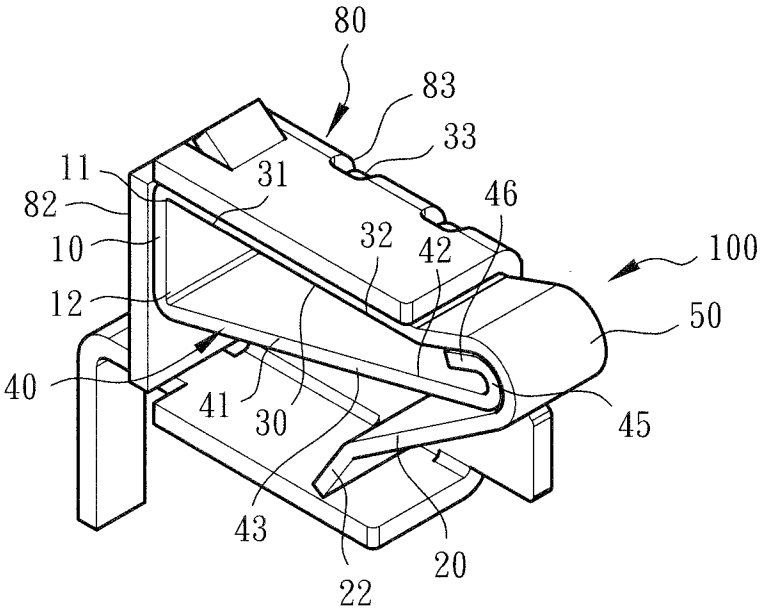
FIG. 1 is a perspective assembled view of the present invention and the electrical connection member, showing that the electrical connection member is formed as a frame body.
Figure 3:
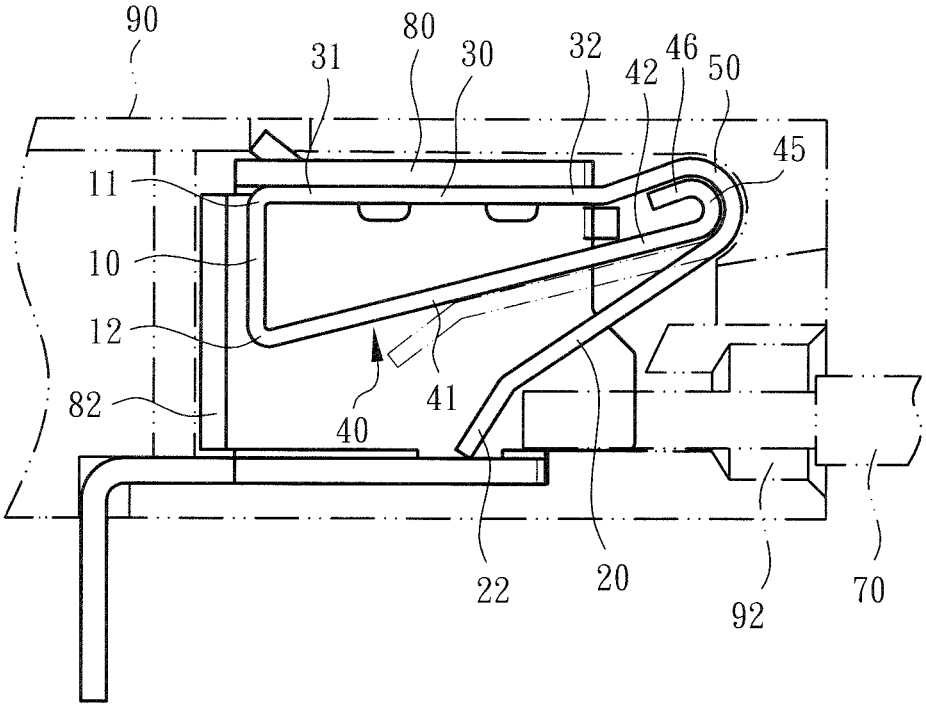
FIG. 3 is a view showing the operation of the metal leaf spring of FIG. 1, in which the phantom lines show that the conductive wire is plugged into the case to bias the second section of the main body.

Please refer to FIGS. 1, 2 and 3. The metal leaf spring protection structure of electrical connection terminal of the present invention includes a main body 100. The main body 100 is selectively made of elastic metal sheet or the like material by means of pressing in the form of a plate body. The main body 100 is mounted on a case 90 made of insulation material. Alternatively, the main body 100 is assembled with an electrical connect ion member 80. The electrical connection member 80 is formed as a frame body and the main body 100 and the electrical connection member 80 are together assembled and mounted on the case 90.

As shown in the drawings, the main body 100 includes a base section 30 defined with a first end 31 and a second end 32. The first end 31 is connected with a first section 10 and a locating section 40.

The second end 32 is connected with a bight section 50 and a reciprocally movable second section 20. The locating section 40 has a head section 41 and a tail section 42 connected with the head section 41. The locating section 40 is positioned in a reciprocally moving path of the second section 20 to set up a moving end point or moving range of the second section 20.

To speak more specifically, a bent section 11 is formed between the first end 31 of the base section 30 and the first section 10. The bent section 11 contains an angle, which is an acute angle, a right angle or an obtuse angle. In addition, the first end 31 is bent toward the second end 32 of the base section 30 and extends to connect with the locating section 40, whereby a subsidiary bent section 12 is formed between the first section 10 and the locating section 40. The subsidiary bent section 12 contains an angle, which is an acute angle, a right angle or an obtuse angle.

As shown in FIG. 3, the locating section 40 obliquely extends in a direction to the upper side of the drawing, whereby the angle contained between the first section 10 and the locating section 40 (or the subsidiary bent section 12) is an acute angle. The second section 20 obliquely extends in a direction to the lower side of the drawing, whereby the angle contained between the second section 20 and the base section 30 is an acute angle.

As shown in FIGS. 1, 2 and 3, the bight section 50 between the second end 32 of the base section 30 and the second section 20 contains an angle, whereby the second section 20 extends in a direction to the first end 31 of the base section 30. At this time, it is defined that the second section 20 is positioned in an initial position. The tail section 42 is bent along the curvature of the bight section 50 to form a hook-like structure 45. When the second section 20 is moved forward to contact or push/press the locating section 40 or the hook-like structure 45, the hook-like structure 45 can support the bight section 50 to provide an elastic action force for helping the second section 20 to move backward toward the initial position. Accordingly, the second section 20 is prevented from being over-biased.

As shown in the drawing, the hook-like structure 45 is bent along the bight section 50 toward the second end 32 of the base section 30. In addition, the hook-like structure 45 is in contact with the bight section 50.

As shown in FIGS. 1 and 2, the lateral side of the base section 30 is formed with finger sections 33 and the electrical connection member 80 is formed with mouth sections 83. The finger sections 33 can be inserted in the mouth sections 83 to securely assemble the main body 100 with the electrical connection member 80 with the second section 20 freely reciprocally movable.

As shown in FIG. 3, the case 90 has a wire plug-in hole 92. The conductive wire 70 can be plugged through the wire plug-in hole 92 into the case 90 to be pressed and restricted by the main body 100 and electrically connected with the electrical connection member 80.

To speak more specifically, when an operator plugs the conductive wire 70 through the wire plug-in hole 92 into the case 90 or the electrical connection member 80, the conductive wire 70 pushes the second section 20 to move in a direction to the locating section 40. Also, in cooperation with the structure of the bight section 50, the second section 20 or the tail end 22 of the second section 20 swings toward the lower side of the drawing to securely press and restrict the conductive wire 70 entering the case 90 or the electrical connection member 80.

It should be noted that when the second section 20 drivingly moves the bight section 50, the hook-like structure 45 provides a system for supporting the bight section 50 to prevent the bight section 50 and the second section 20 from being over-biased. In addition, the hook-like structure 45 will provide an elastic action force to push/press the second section 20 so as to help the second section 20 to securely press and restrict the conductive wire 70.

It should be noted that the locating section 40 of the main body 100 serves as a moving end point structure of the second section 20. This ensures that when the second section 20 is pushed/pressed and biased by the conductive wire 70, the second section 20 is prevented from being over-biased as the clamping leg of the conventional terminal that passes over the stop point (or the protrusion section). In addition, the locating section 40 has the form of an (entirely) plane structure, whereby the second section 20 can snugly attach to the locating section 40 without deflecting.

Figure 4:
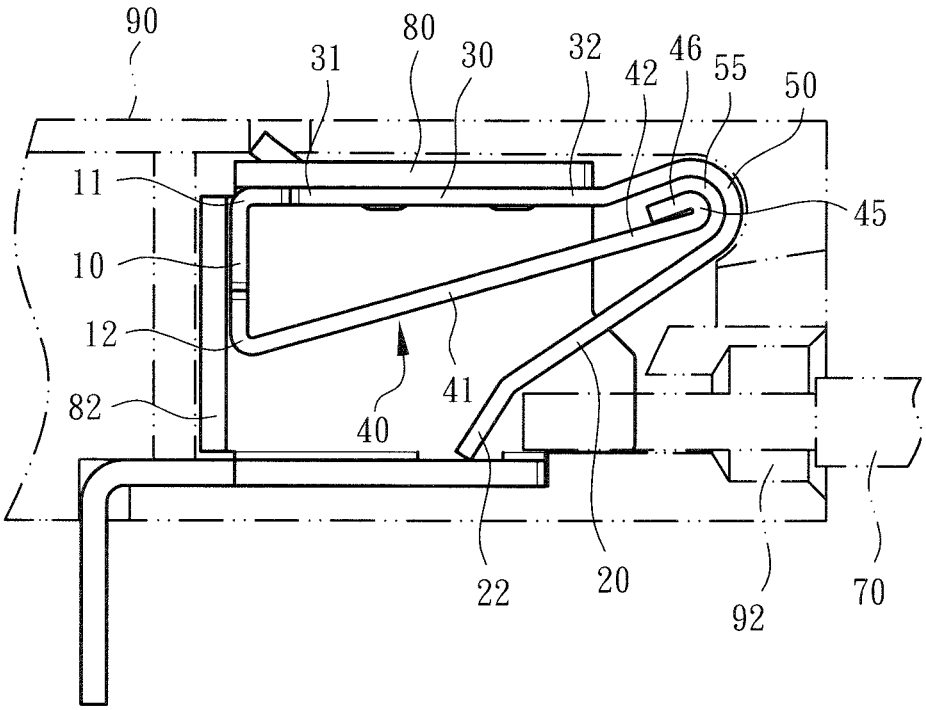
FIG. 4 is a view of a preferred embodiment of the present invention, showing the structure of the locating section extending to the bight section.

Please now refer to FIG. 4, which shows a modified embodiment of the main body 100 of the present invention. In this embodiment, the tail section 42 of the locating section 40 of the main body 100 extends to a position of the bight section 50. The hook-like structure 45 is bent along the bight section 50 toward the second end 32 of the base section 30 and spaced from the bight section 50 by a gap.

FIG. 4 also shows that a rear end section 46 of the hook-like structure 45 is pressed against the tail section 42.

Therefore, when the conductive wire 70 pushes the second section 20 to move toward the locating section 40, the gap 55 provides an elastic moving space. After the second section 20 reaches or contacts the tail section 42, the second section 20 will first push the hook-like structure 45 to move toward the upper side of the drawing until the hook-like structure 45 contacts the bight section 50 or the second end 32 of the base section 30. At this time, the locating section 40 (or the tail section 42) will prevent the second section 20 from being over-biased. Accordingly, a locating support point is set up to ensure that the locating section 40 prevents the second section 20 from being over-biased.

In this embodiment, the size of the gap defined between the hook-like structure 45 and the bight section 50 determines the moving range of the second section 20.

FIG. 4 also shows a preferred embodiment in which the first section 10 is attached to the sidewall 82 of the electrical connection member 80, whereby the electrical connection member 80 provides a support effect for the main body 100 so that the main body 100 and the electrical connection member 80 can be more securely assembled with each other.

Figure 5:
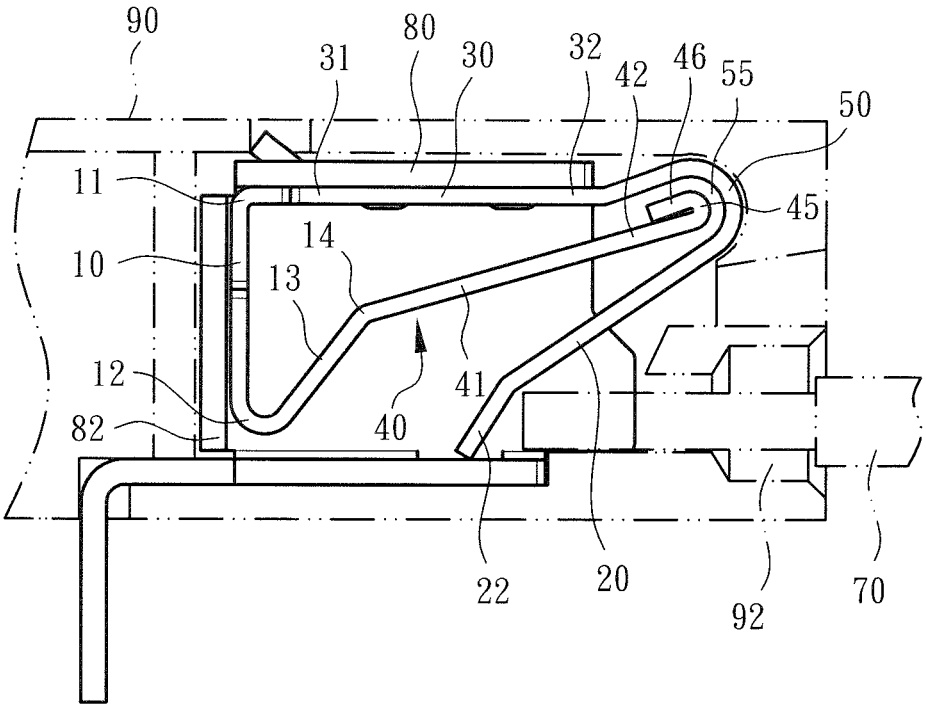
FIG. 5 is a view of a preferred embodiment of the present invention, showing the structure of the subsidiary bent section between the first section and the locating section.

Please now refer to FIG. 5, which shows a modified embodiment of the main body 100 of the present invention. In this embodiment, a connection section 13 is disposed between the subsidiary bent section 12 and the locating section 40.

To speak more specifically, the connection section 13 obliquely extends in a direction to the second end 32 of the base section 30 to forma reverse bent section 14 connected with the locating section 40. As shown in the drawing, the angle contained between the first section 10 and the connection section 13 (or the subsidiary bent section 12) is an acute angle smaller than the obtuse angle contained between the connection section 13 and the locating section 40 (or the reverse bent section 14).

Figure 6:
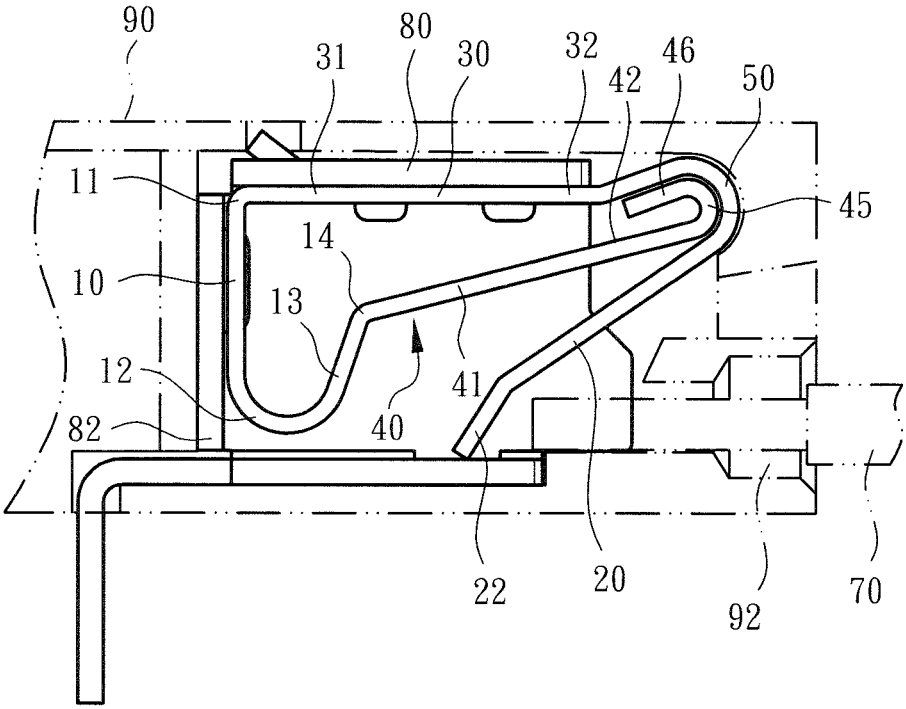
FIG. 6 is a view of a modified embodiment of the present invention, showing the structure of the subsidiary bent section between the first section and the locating section.

Please refer to FIG. 6, which shows the structure of the subsidiary bent section 12 between the first section 10 and the locating section 40. The subsidiary bent section 12 is formed with an arched structure as the connection section 13. The connection section 13 obliquely extends in a direction to the base section 30 and the second end 32 to form the reverse bent section 14 connected with the locating section 40.

It should be noted that the structural form of the first section 10, the subsidiary bent section 12 and the connection section 13 as shown in FIGS. 5 and 6 increases the length of the first section 10. Correspondingly, the attachment length or area of the first section 10 to the sidewall 82 of the electrical connection member 80 is increased so that the electrical connection member 80 can provide greater support effect for the main body 100 and the main body 100 and the electrical connection member 80 can be more securely assembled with each other.

Figure 7:
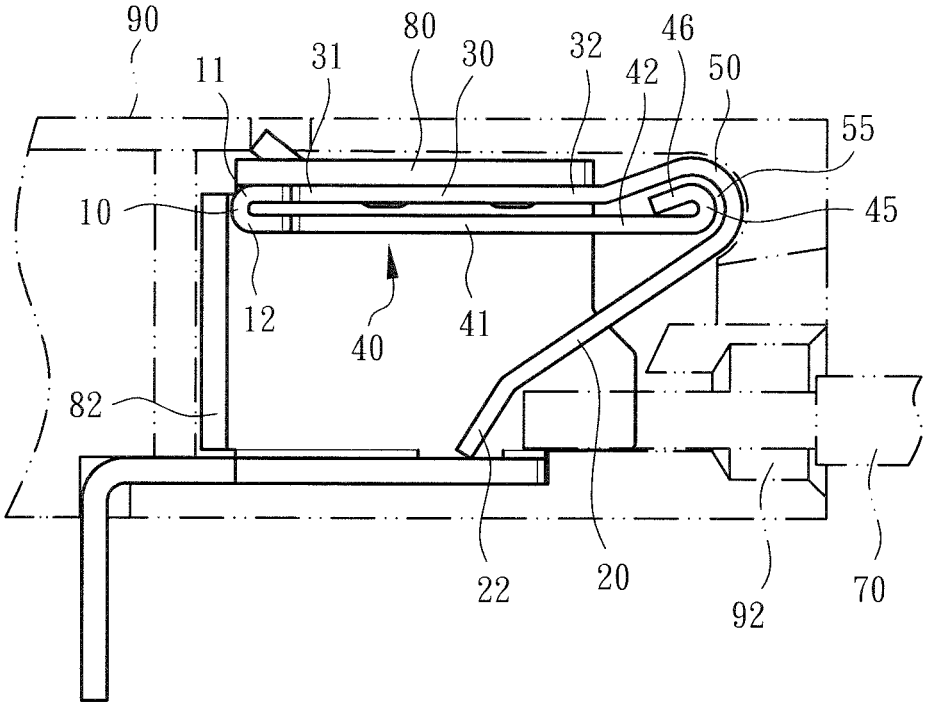
FIG. 7 is a view of a modified embodiment of the present invention, showing that the locating section is parallel to the base section and the locating section extends to the bight section.

Please now refer to FIG. 7, which shows a preferred embodiment of the main body 100 of the present invention. In this embodiment, the length of the first section 10 is as minimized as possible. Also, through the subsidiary bent section 12, the first section 10 is bent toward the second end 32 of the base section 30 and extends to form the locating section 40. In addition, the locating section 40 is parallel to the base section 30.

FIG. 7 also shows that the tail section 42 of the locating section 40 extends to the position of the bight section 50 to form the hook-like structure 45. The hook-like structure 45 is bent along the bight section 50 toward the second end 32 of the base section 30. In addition, a gap 55 is defined between the hook-like structure 45 and the bight section 50.

Figure 8:
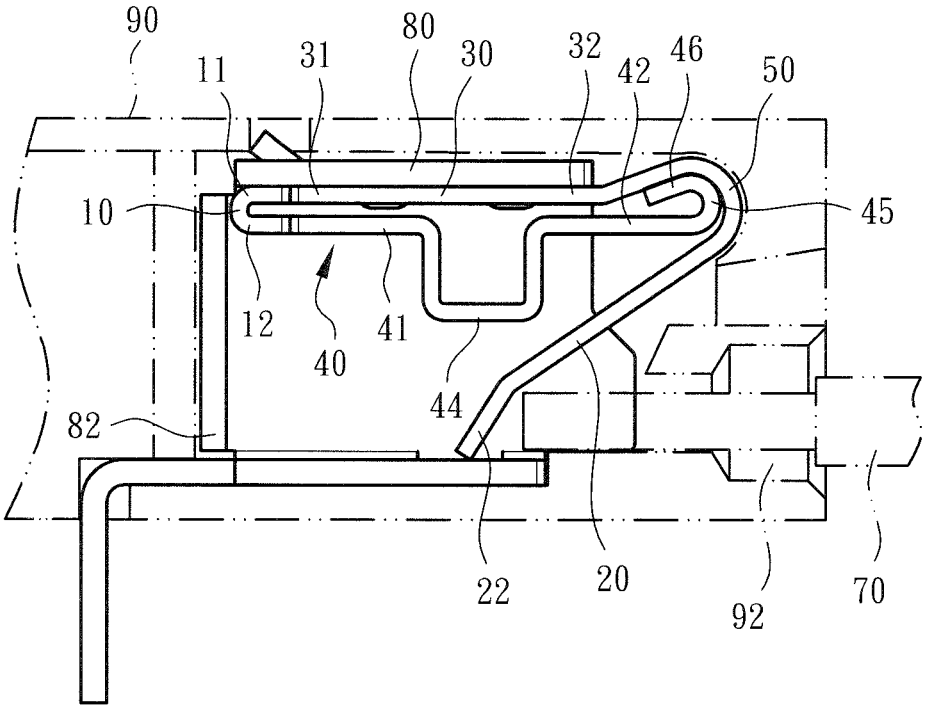
FIG. 8 is a view of a modified embodiment of the present invention, showing that the locating section is bent into a U-shaped structure.

Please now refer to FIG. 8, which shows a modified embodiment of the main body 100. As shown in the drawing, the length of the first section 10 is as minimized as possible. Also, through the subsidiary bent section 12, the first section 10 is bent toward the second end 32 of the base section 30 and extends to form the locating section 40. In addition, the locating section 40 is parallel to the base section 30.

FIG. 8 also shows that the tail section 42 of the locating section 40 extends to the position of the bight section 50 to form the hook-like structure 45. The head section 41 is formed with a U-shaped structure 44 in a direction away from the base section 30 (or to the lower side of the drawing). In cooperation with the structures of the head section 41 and the tail section 42 of the locating section 40 in contact with or in parallel to the base section 30, the U-shaped structure 44 and the hook-like structure 45 in contact with the bight section 50 respectively set up a locating support point to prevent the second section 20 from being over-biased.

Figure 9:
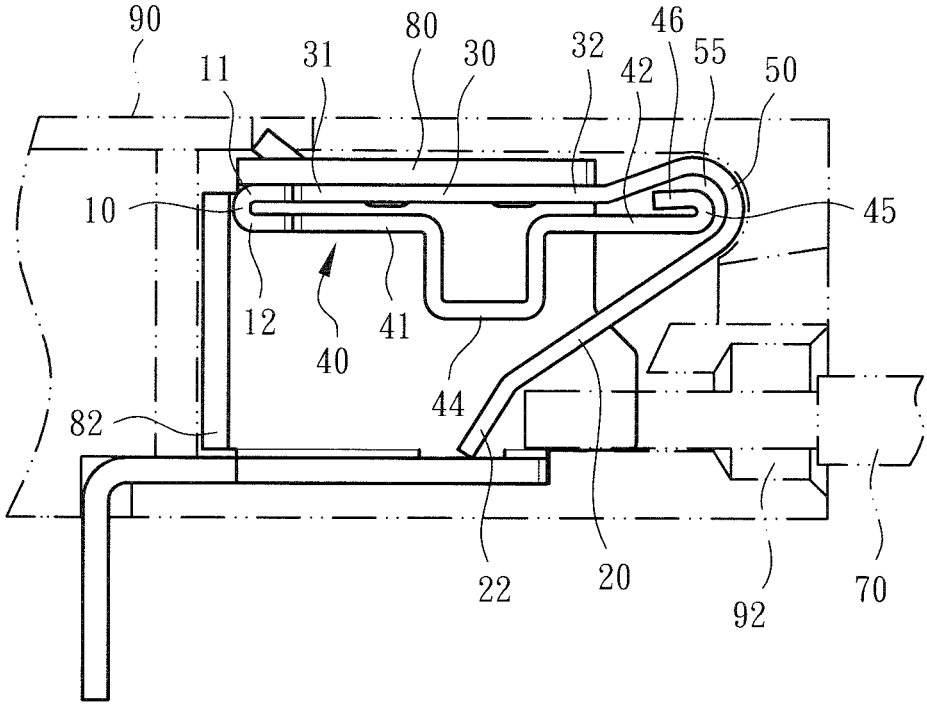
FIG. 9 is a view of a preferred embodiment of the present invention, showing that the locating section is bent into a U-shaped structure.

FIG. 9 is a view of a modified embodiment of the main body 100, showing the structure of the locating section 40 extending to the bight section 50. As shown in the drawing, the locating section 40 is parallel to the base section 30. The head section 41 is formed with a U-shaped structure 44 in a direction away from the base section 30 (or to the lower side of the drawing). Also, the tail section 42 extends to a position of the bight section 50 to form a hook-like structure 45 in a direction to the base section 30 (or the second end 32). A gap is defined between the hook-like structure 45 and the bight section 50.

FIG. 9 also shows that the bending angle of the hook-like structure 45 is different from the bending angle of the bight section 50.

Figure 10:
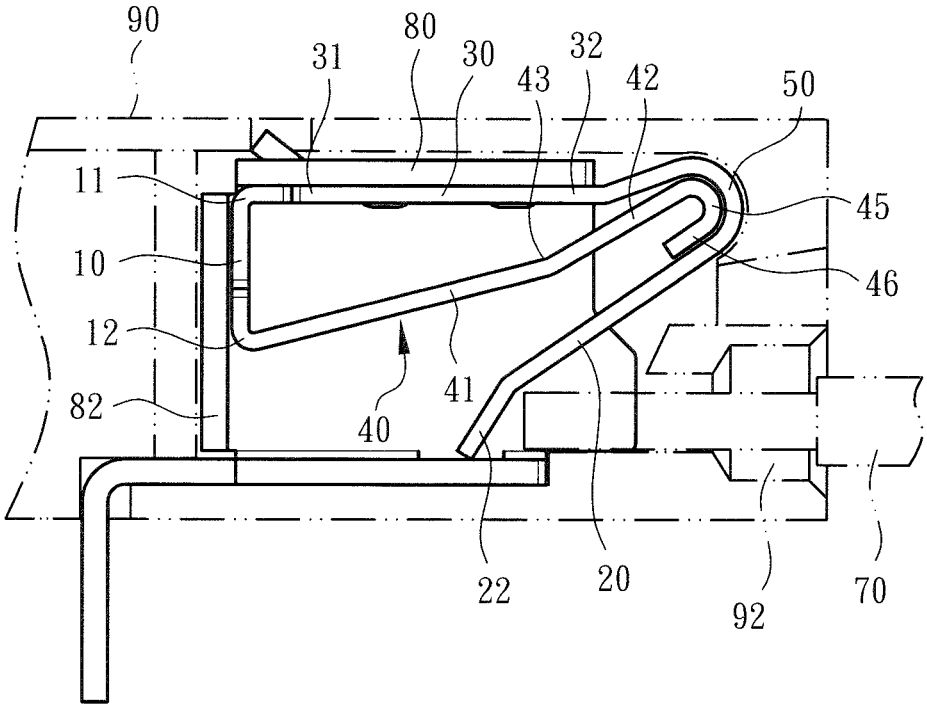
FIG. 10 is a view of a modified embodiment of the present invention, showing the structure of the sub-bent section formed on the locating section.

FIG. 10 shows the structure of the tail section 42 of the locating section 40. The locating section 40 has a sub-bent section 43 formed between the head section 41 and the tail section 42. As shown in the drawing, the angle contained between the head section 41 and the tail section 42 (or the sub-bent section 43) is an obtuse angle, whereby the tail section 42 extends to the position of the bight section 50 to form the hook-like structure 45.

In this embodiment, the hook-like structure 45 is bent along the bight section 50 in a direction to the second section 20 or the tail end 22 thereof. In addition, the hook-like structure 45 is in contact with the bight section 50. Therefore, the locating section 40 (or the head section 41) and the hook-like structure 45 respectively provide a locating support system and the hook-like structure 45 can provide an elastic action force in response to the move of the second section 20 toward the locating section 40 to enhance the effect that the second section securely presses and restricts the conductive wire 70.

Figure 11:
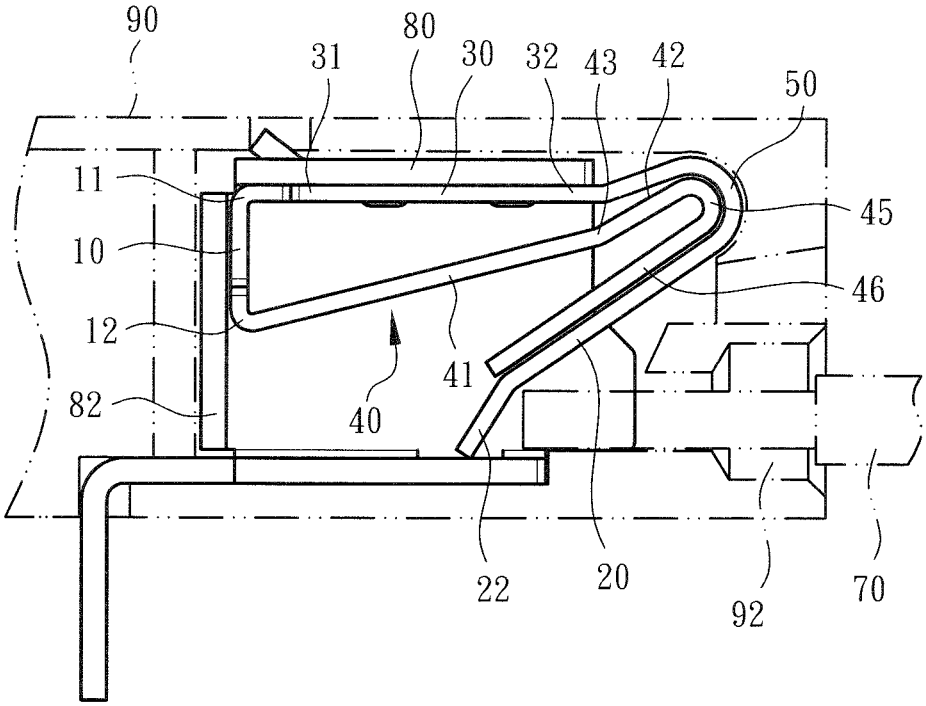
FIG. 11 is a view of a modified embodiment of the present invention, showing the structure of the sub-bent section and the tail section formed on the locating section.

Please now refer to FIG. 11, which shows a modified embodiment of the main body 100. In this embodiment, the rear end section 46 of the hook-like structure 45 extends along the bight section 50 toward the second section 20 (or the tail end 22 thereof). The rear end section 46 is in contact with and in parallel to the second section 20. This also enhances the action force of the second section 20 for securely pressing and restricting the conductive wire 70.

Figure 12:
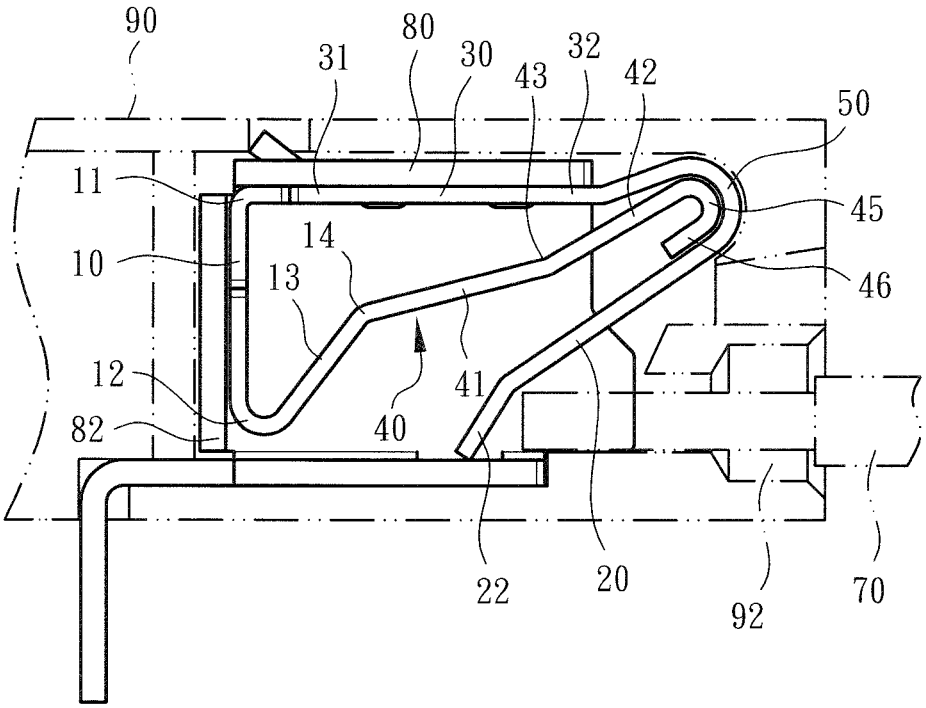
FIG. 12 is a view of a modified embodiment of the present invention, showing the structure of the sub-bent section formed on the locating section.

FIG. 12 is a view of a preferred embodiment of the main body 100, showing the structure of the subsidiary bent section 12 between the first section 10 and the locating section 40 and showing that the locating section 40 extends to the bight section 50. In this embodiment, a connection section 13 is disposed between the subsidiary bent section 12 and the locating section 40. The connection section 13 obliquely extends in a direction to the second end 32 of the base section 30 to form a reverse bent section 14 connected with the locating section 40 (or the head section 41). In addition, a sub-bent section 43 is formed between the head section 41 and the tail section 42.

Figure 13:
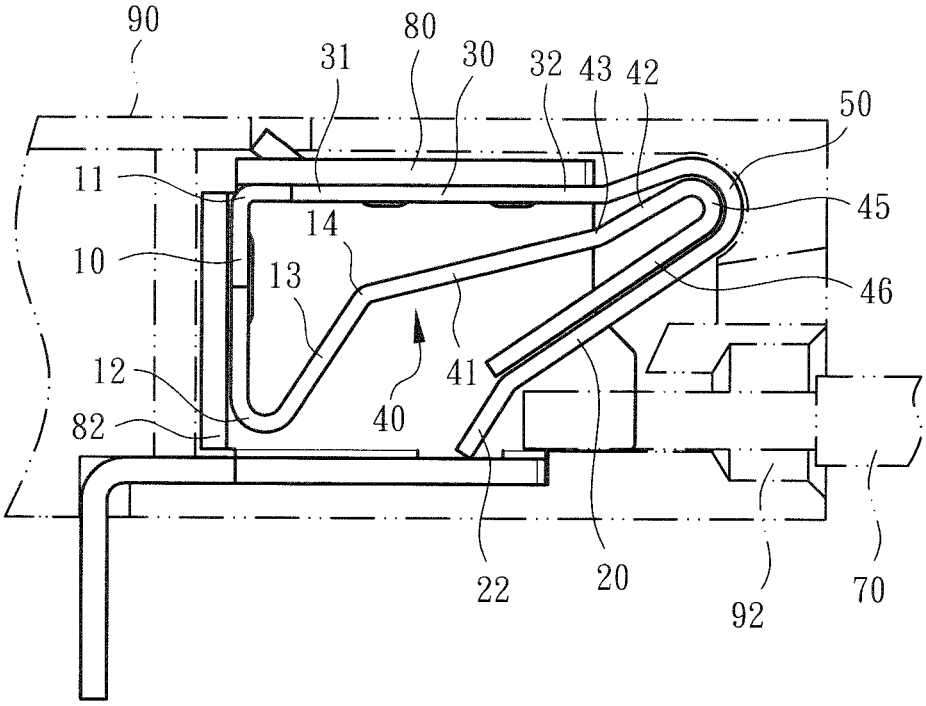
FIG. 13 is a view of a preferred embodiment of the present invention, showing the structure of the sub-bent section and the tail section formed on the locating section.

FIG. 13 shows that a connection section 13 is disposed between the subsidiary bent section 12 and the locating section 40 of the main body 100. The connection section 13 obliquely extends in a direction to the second end 32 of the base section 30 to form a reverse bent section 14 connected with the locating section 40 (or the head section 41). A sub-bent section 43 is formed between the head section 41 and the tail section 42. In addition, the rear end section 46 of the hook-like structure 45 extends along the bight section 50 toward the second section 20 (or the tail end 22 thereof). The rear end section 46 is in contact with and in parallel to the second section 20.

Figure 14:
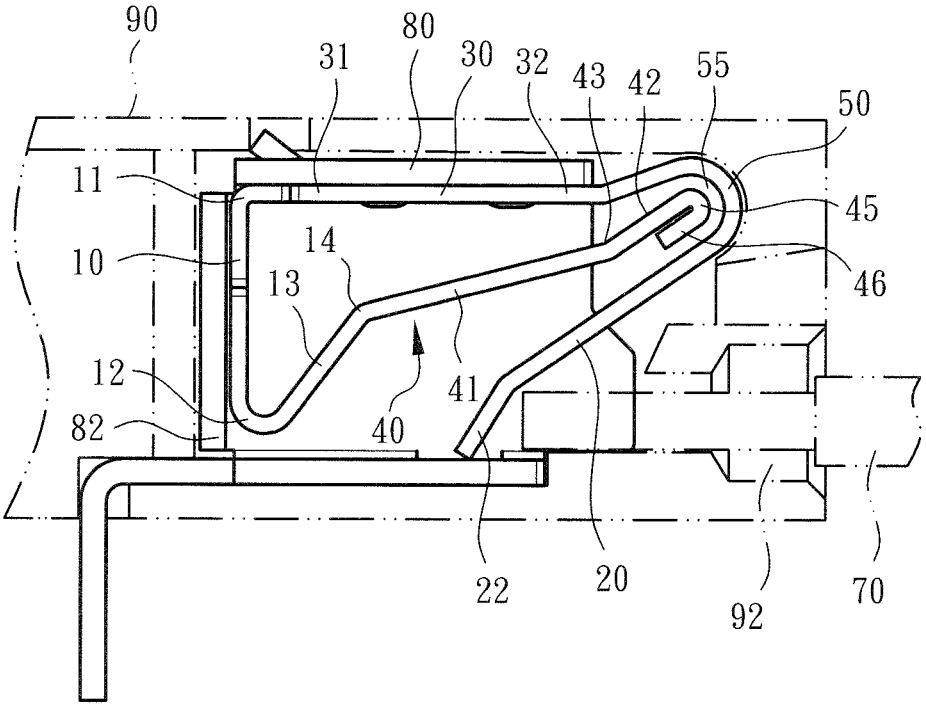
FIG. 14 is a view of a modified embodiment of the present invention, showing the structure of the sub-bent section formed on the locating section.

FIG. 14 shows a modified embodiment of the main body 100. In this embodiment, a sub-bent section 43 is formed between the head section 41 and the tail section 42 and the hook-like structure 45 is bent toward the second section 20 (or the tail end 22 thereof). In addition, a gap 55 is defined between the hook-like structure 45 and the bight section 50.

Figure 15:
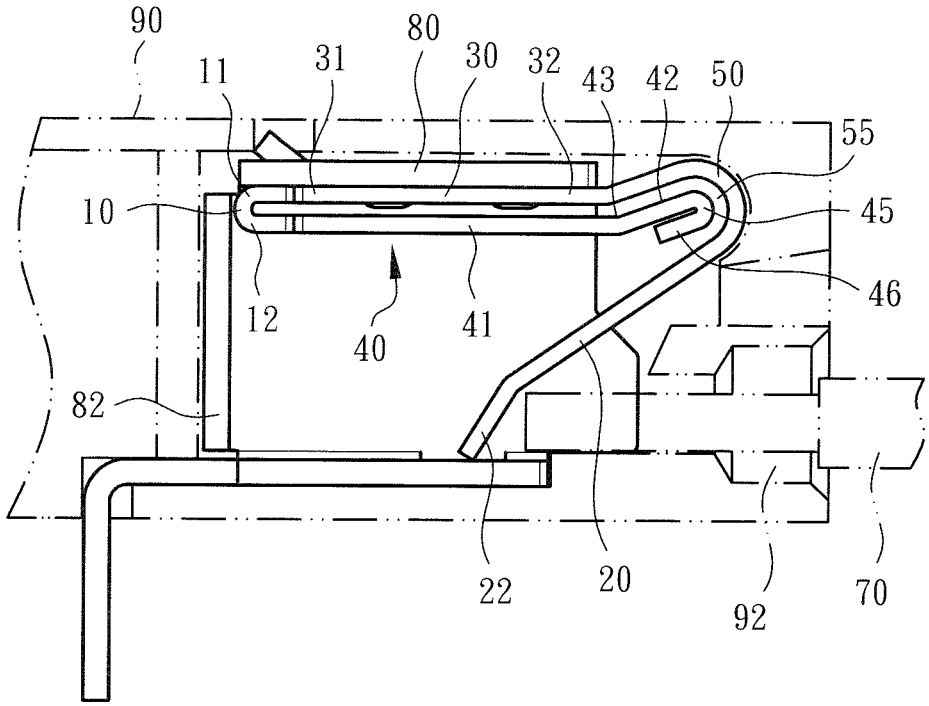
FIG. 15 is a view of a modified embodiment of the present invention, showing that the locating section is parallel to the base section.

FIG. 15 shows a modified embodiment of the main body 100. In this embodiment, the length of the first section 10 is as minimized as possible. Also, through the subsidiary bent section 12, the first section 10 is bent toward the second end 32 of the base section 30 and extends to form the locating section 40. In addition, the locating section 40 is parallel to the base section 30.

Also, as shown in the drawing, the tail section 42 of the locating section 40 extends to a position of the bight section 50 to form a hook-like structure 45. The hook-like structure 45 is bent along the bight section 50 toward the second section 20. In addition, a gap 55 is defined between the hook-like structure 45 and the bight section 50.

FIG. 15 also shows that a sub-bent section 43 is formed on the tail section 42 and the rear end section 46 of the hook-like structure 45 is pressed against the tail section 42 to change the moving range of the second section 20.

Figure 16:
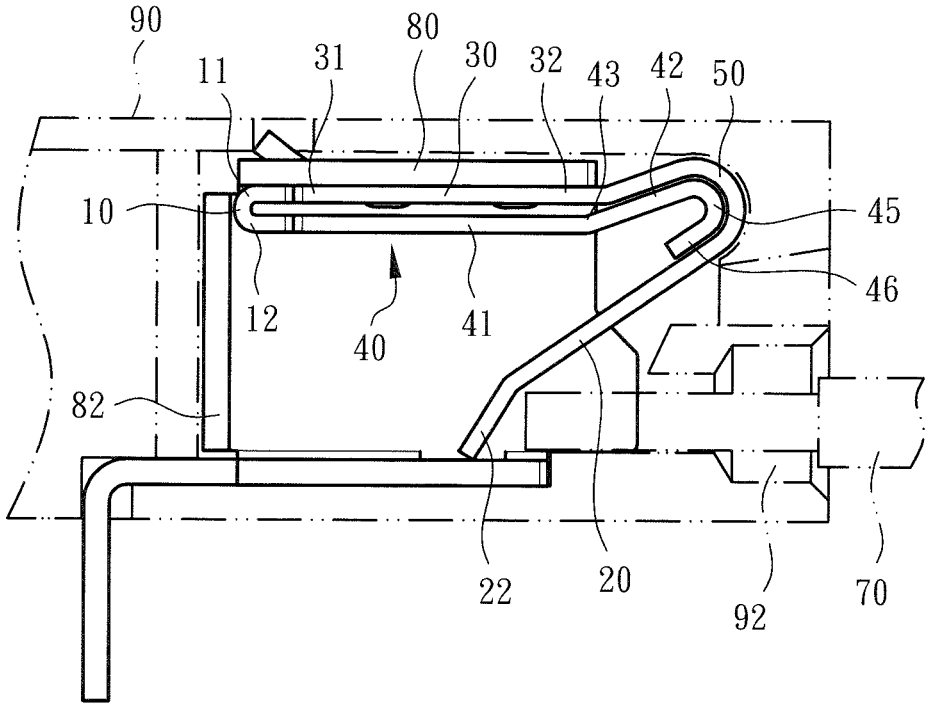
FIG. 16 is a view of a modified embodiment of the present invention, showing that the locating section is parallel to the base section.

Please now refer to FIG. 16, which shows that the locating section 40 is parallel to the base section 30 and the hook-like structure 45 is bent along the curvature of the bight section 50 toward the second section 20 (or the tail end 22 thereof). In addition, the hook-like structure 45 is in contact with the bight section 50.

Figure 17:
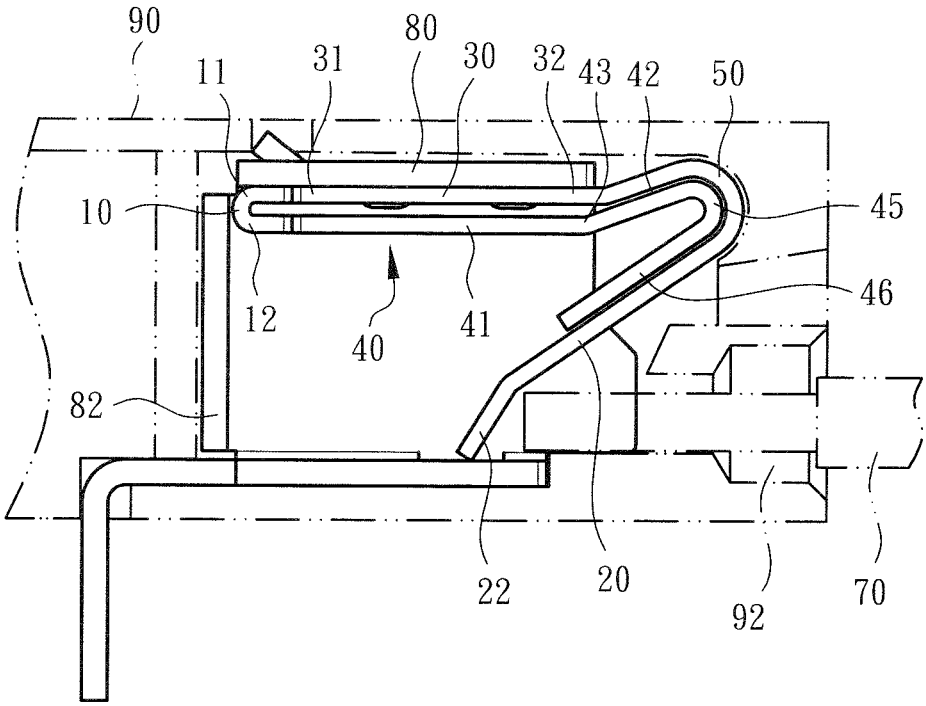
FIG. 17 is a view of a preferred embodiment of the present invention, showing that the locating section is parallel to the base section and showing the structure of the tail section.

FIG. 17 shows that the locating section 40 is parallel to the base section 30 and the hook-like structure 45 is bent along the curvature of the bight section 50 toward the second section 20 (or the tail end 22 thereof). In addition, the hook-like structure 45 and the rear end section 46 thereof are respectively in contact with the bight section 50 and the second section 20.

Figure 18:
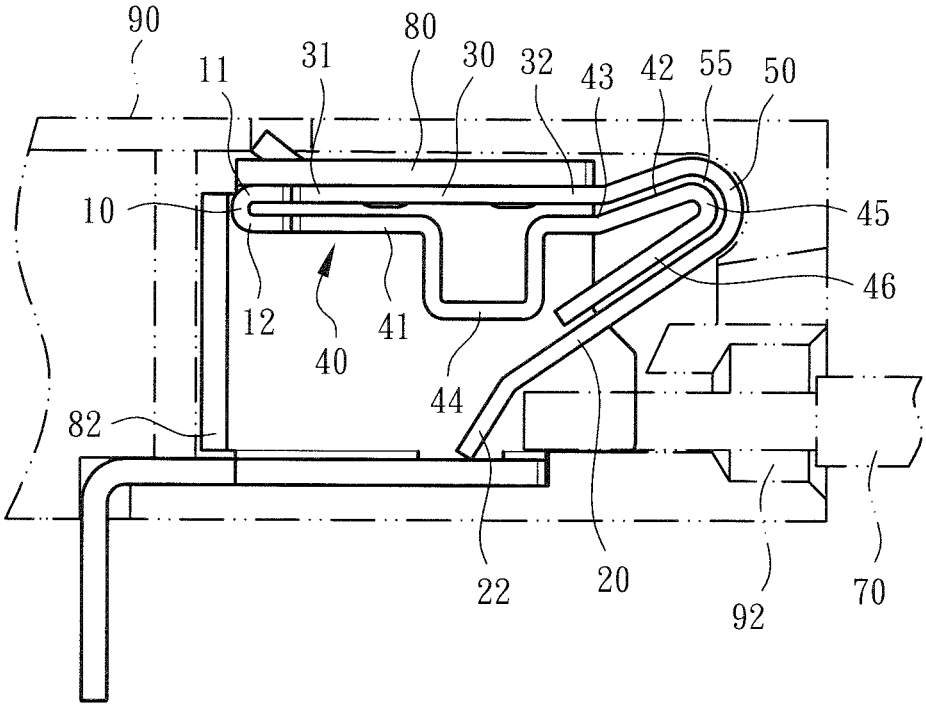
FIG. 18 is a view of a modified embodiment of the present invention, showing that the locating section is formed with a U-shaped structure and a tail section.

FIG. 18 shows that the locating section 40 is parallel to the base section 30 and the head section 41 is formed with a U-shaped structure 44 in a direction away from the base section 30 (or to the lower side of the drawing). Also, the tail section 42 extends to a position of the bight section 50 and is bent toward the second section 20 to form a hook-like structure 45. In addition, a gap 55 is defined between the hook-like structure 45 and the bight section 50 and the rear end section 46 is parallel to the second section 20.

In this embodiment, in cooperation with the structures of the head section 41 and the tail section 42 of the locating section 40 in contact with or in parallel to the base section 30, the U-shaped structure 44 and the hook-like structure 45 respectively set up a locating support point to prevent the second section 20 from being over-biased.

Figure 19:
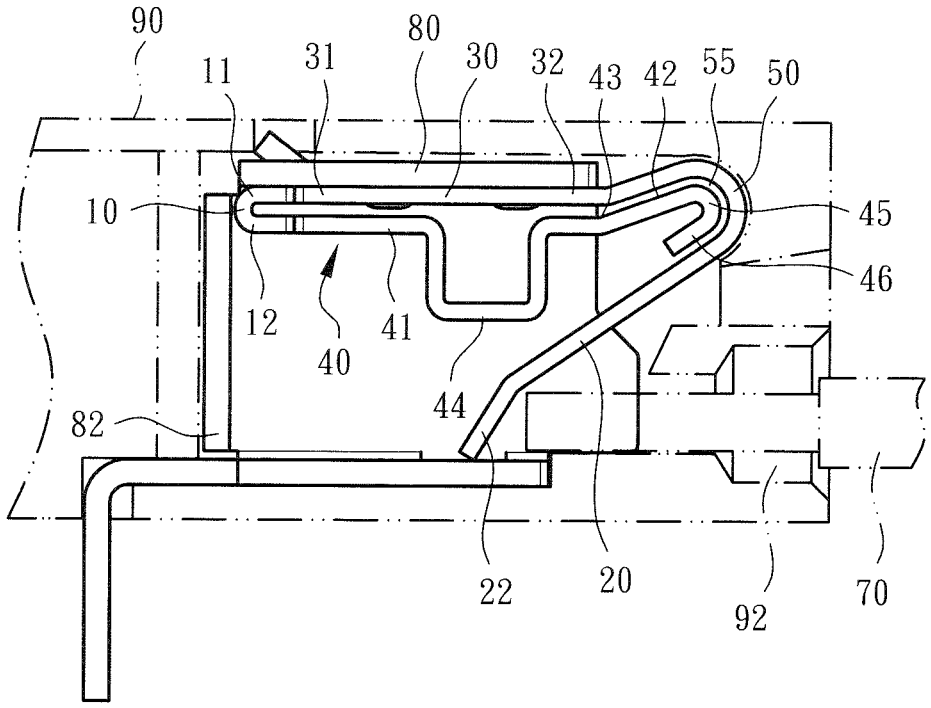
FIG. 19 is a view of a modified embodiment of the present invention, showing that the locating section is formed with a U-shaped structure and a tail section.

Please now refer to FIG. 19, which shows that the locating section 40 is parallel to the base section 30 and the head section 41 is formed with a U-shaped structure 44 in a direction away from the base section 30 (or to the lower side of the drawing). Also, the tail section 42 extends to a position of the bight section 50 and is bent toward the second section 20 to form a hook-like structure 45. In addition, a gap 55 is defined between the hook-like structure 45 and the bight section 50.

Figure 20:
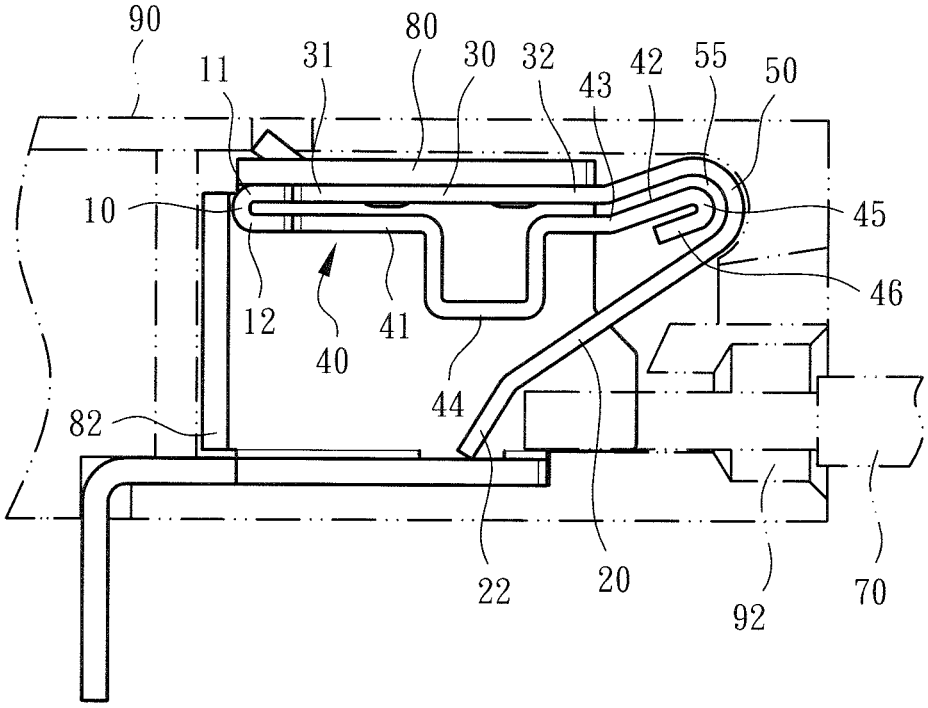
FIG. 20 is a view of a preferred embodiment of the present invention, showing that the locating section is formed with a U-shaped structure and a tail section.

FIG. 20 shows that the locating section 40 is parallel to the base section 30 and the head section 41 is formed with a U-shaped structure 44 in a direction away from the base section 30 (or to the lower side of the drawing). Also, the tail section 42 extends to a position of the bight section 50 and is bent toward the second section 20 to form a hook-like structure 45. In addition, a gap 55 is defined between the hook-like structure 45 and the bight section 50.

Also, as shown in the drawing, the rear end section 46 is biased toward the hook-like structure 45 or the tail section 42.

Figure 22:
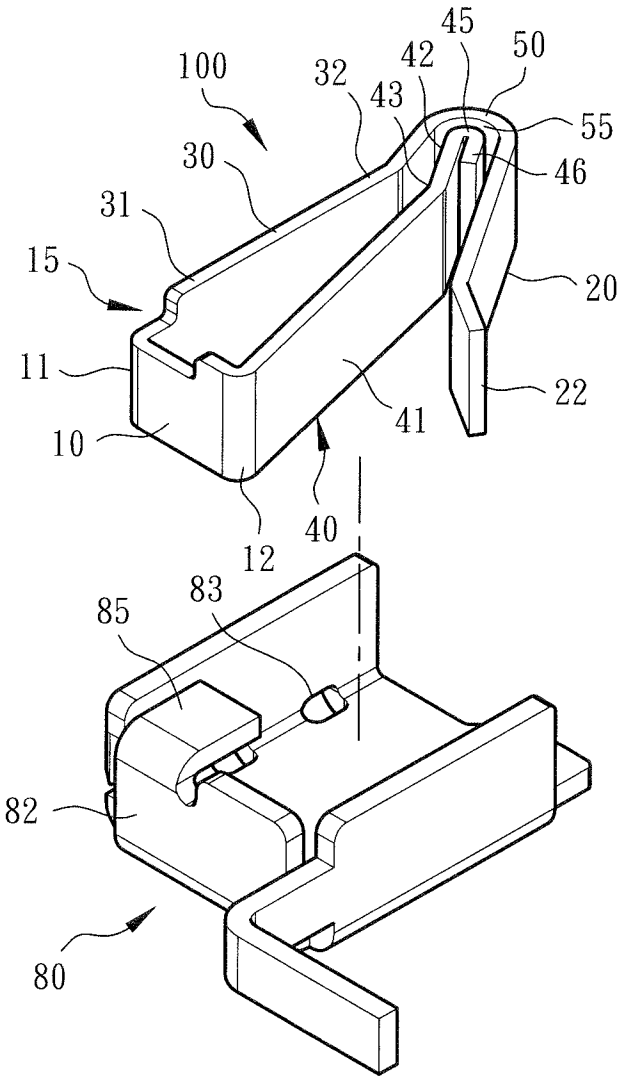
FIG. 22 is a perspective exploded view according to FIG. 21.
Figure 21:
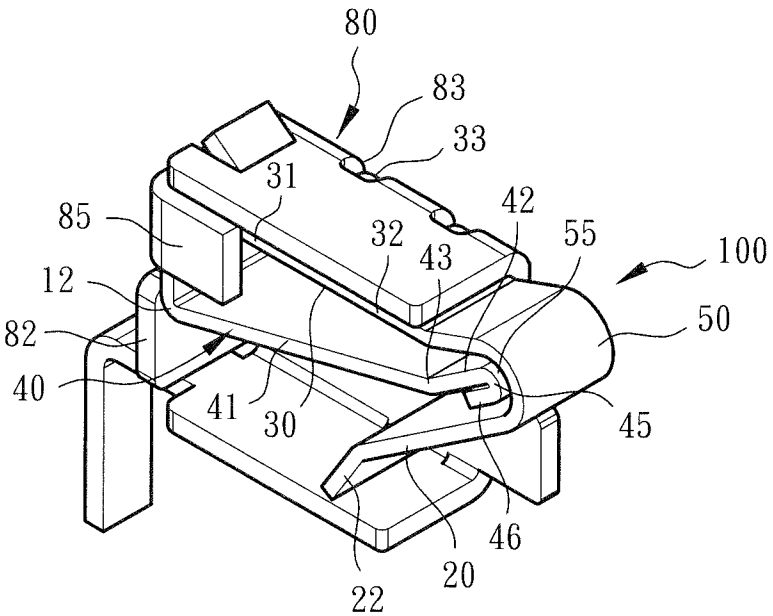
FIG. 21 is a perspective assembled view of the present invention and the electrical connection member, showing that the electrical connection member is formed as a frame body and an insertion section is formed on a sidewall of the frame body.
Figure 23:
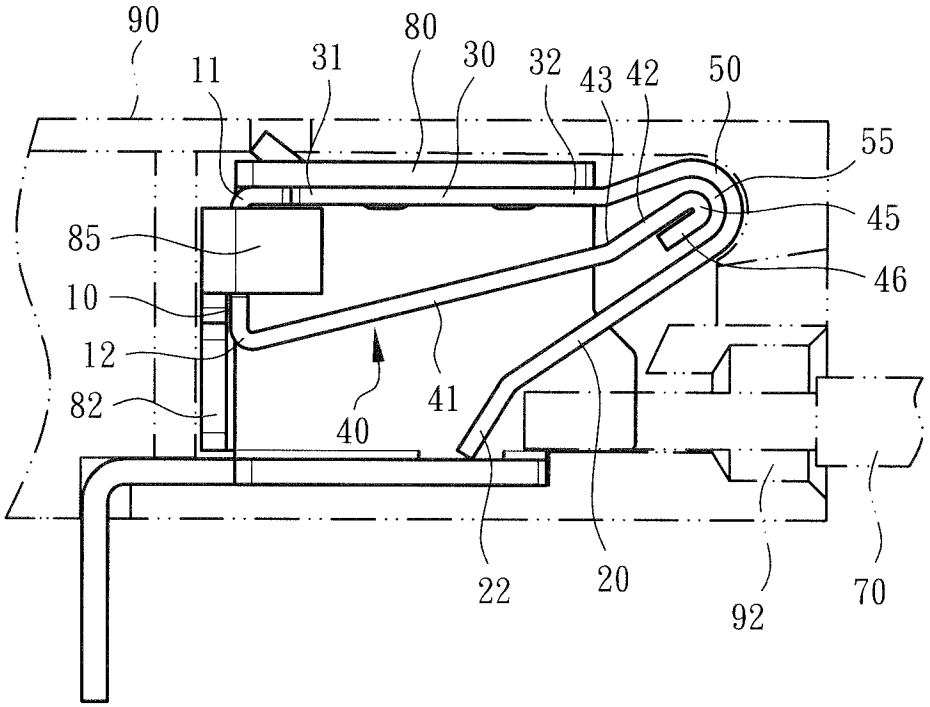
FIG. 23 is a view showing the operation of the metal leaf spring of FIG. 1, in which the phantom lines show that the conductive wire is plugged into the case to bias the second section of the main body.

Please now refer to FIGS. 21, 22 and 23, which show a preferred embodiment of the main body 100 and the electrical connection member 80. As shown in the drawings, the subsidiary bent section 12 of the main body 100 obliquely extends in a direction to the second end 32 of the base section 30 to connect with the locating section 40 (or the head section 41). A sub-bent section 43 is formed between the head section 41 and the tail section 42, whereby the tail section 42 extends to the position of the bight section 50 to form the hook-like structure 45. In addition, a gap 55 is defined between the hook-like structure 45 and the bight section 50.

In this embodiment, an insertion section 85 is disposed on a sidewall 82 of the electrical connection member 80. The insertion section 85 is a plate-shaped body bent from the sidewall 82 and protruding from the sidewall 82. An assembling section 15 is formed between the base section 30 and the first section 10 of the main body 100 corresponding to the insertion section 85 of the electrical connection member 80. The assembling section 15 is a notch structure. When the main body 100 is assembled with the electrical connection member 80, the insertion section 85 is connected with the assembling section 15, whereby the main body 100 can be more securely assembled with the electrical connection member 80.

To speak representatively, in condition of optimal and stable operation, in comparison with the conventional electrical connection terminal, the metal leaf spring protection structure of electrical connection terminal of the present invention has the following advantages:

1. The main body 100 and the electrical connection terminal device or the relevant connection components thereof have been redesigned in use, structure and connection relationship. For example, the bent section 11 is formed between the base section 30 and the first section 10 of the main body 100 and the subsidiary bent section 12 is formed between the first section 10 and the locating section 40. The head section 41 of the locating section 40 is formed with the U-shaped structure 44. The tail section 42 of the locating section 40 is formed with the sub-bent section 43 in a direction to the base section 30. The tail section 42 extends to a position of the bight section 50 to form the hook-like structure 45 and/or the gap 55. The rear end section 46 extends along the second section 20. The structure of the present invention is obviously different from the conventional electrical connection terminal. Also, the present invention changes the use form of the conventional electrical connection terminal.
2. In the structural form of the main body 100 and/or the electrical connection member 80, the structure of the cooperative protrusion section additionally formed on the reception member (or frame body) of the conventional electrical connection terminal is removed. Accordingly, the present invention improves the shortcoming of the conventional electrical connection terminal that the cooperative structure is relatively complicated and the clamping leg (or the free end of the metal leaf spring) is apt to deflect and pass over the protrusion section to deteriorate the effect that the protrusion section prevents the clamping leg from being over-biased.
3. In the condition that the metal leaf spring can keep stably pressing and restricting the conductive wire, a true moving range of the main body 100 (or the second section 20 thereof) is set up. The locating section 40 of the main body 100 itself forms a preset end position, which is formed by means of directly pressing the main body 100. In contrast, in the conventional electrical connection terminal, it is necessary to additionally dispose a cooperative component or stop component. The present invention obviously can lower the manufacturing cost. Furthermore, the second section 20 can only move to reach the set end position, where the main body 100 and/or the locating section 40 can stop the second section 20. Therefore, no matter how the second section 20 moves (or deflects), the free end of the second section 20 cannot pass over the main body 100 so that the free end is prevented from being over-biased. In this case, the possibility that the metal leaf spring is over-bent to shorten the lifetime of the electrical connection terminal as in the conventional structure is minimized.

4. Especially, by means of the structural form that the hook-like structure 45 is assembled with the bight section 50, when the second section 20 is moved forward to contact or push/press the locating section 40 or the hook-like structure 45, the hook-like structure 45 not only serves as a system for supporting the bight section 50, but also provides an elastic action force for helping the second section 20 to move backward toward the initial position. Accordingly, the second section 20 is prevented from being over-biased. In addition, the hook-like structure 45 or the rear end sect ion 46 and the second sect ion 20 cooperate with each other to provide an action force for enhancing the effect that the second section 20 securely presses and restricts the conductive wire 70.

In conclusion, the metal leaf spring protection structure of electrical connection terminal of the present invention is different from the conventional electrical connection terminal in space form and is advantageous over the conventional electrical connection terminal. The metal leaf spring protection structure of electrical connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. A metal leaf spring protection structure of electrical connection terminal, comprising a main body, the main body having a base section defined with a first end and a second end, the first end being connected with a first section and a locating section, the second end being connected with a bight section and a reciprocally movable second section, a bent section being formed between the first end of the base section and the first section, the bent section containing an angle, the angle contained by the bent section being selected from a group consisting of an acute angle, a right angle and an obtuse angle, the first section being bent toward the second end of the base section and extending to connect with the locating section, whereby a subsidiary bent section is formed between the first section and the locating section, the subsidiary bent section containing an angle, the angle contained by the subsidiary bent section being selected from a group consisting of an acute angle, a right angle and an obtuse angle, the locating section having a head section and a tail section connected with the head section, the tail section extending to a position of the bight section to form a hook-like structure and a rear end section, the bight section between the second section and the second end of the base section containing an angle, whereby the second section obliquely extends in a direction toward the first end of the base section, the locating section being positioned in a reciprocal movement path of the second section to define a movement end point of the second section.

2. The metal leaf spring protection structure of electrical connection terminal as claimed in claim 1, wherein the main body is disposed on a case or an electrical connection member.

3. The metal leaf spring protection structure of electrical connection terminal as claimed in claim 2, wherein a lateral side of the base section is formed with finger sections and the electrical connection member is formed with mouth sections, the finger sections being inserted in the mouth sections to securely assemble the main body with the electrical connection member, an insertion section being disposed on a sidewall of the electrical connection member, the insertion section being a plate-shaped body bent from the sidewall and protruding from the sidewall, an assembling section being formed between the base section and the first section of the main body, the assembling section being a notch structure, the first section being pressed against the sidewall of the electrical connection member.

4. The metal leaf spring protection structure of electrical connection terminal as claimed in claim 1, wherein the locating section of the main body has the form of a plane structure, a sub-bent section being formed between the head section and the tail section, the sub-bent section containing an angle, which is an obtuse angle, whereby the tail section obliquely extends in a direction to the base section.

5. The metal leaf spring protection structure of electrical connection terminal as claimed in claim 2, wherein the locating section of the main body has the form of a plane structure, a sub-bent section being formed between the head section and the tail section, the sub-bent section containing an angle, which is an obtuse angle, whereby the tail section obliquely extends in a direction to the base section.

6. The metal leaf spring protection structure of electrical connection terminal as claimed in claim 3, wherein the locating section of the main body has the form of a plane structure, a sub-bent section being formed between the head section and the tail section, the sub-bent section containing an angle, which is an obtuse angle, whereby the tail section obliquely extends in a direction to the base section.

7. The metal leaf spring protection structure of electrical connection terminal as claimed in claim 1, wherein the hook-like structure extends along the bight section toward the base section or toward the second section, a gap being defined between the hook-like structure and the bight section or the hook-like structure being in contact with the bight section.

8. The metal leaf spring protection structure of electrical connection terminal as claimed in claim 2, wherein the hook-like structure extends along the bight section toward the base section or toward the second section, a gap being defined between the hook-like structure and the bight section or the hook-like structure being in contact with the bight section.

9. The metal leaf spring protection structure of electrical connection terminal as claimed in claim 3, wherein the hook-like structure extends along the bight section toward the base section or toward the second section, a gap being defined between the hook-like structure and the bight section or the hook-like structure being in contact with the bight section.

10. The metal leaf spring protection structure of electrical connection terminal as claimed in claim 4, wherein the hook-like structure extends along the bight section toward the base section or toward the second section, a gap being defined between the hook-like structure and the bight section or the hook-like structure being in contact with the bight section.

11. The metal leaf spring protection structure of electrical connection terminal as claimed in claim 5, wherein the hook-like structure extends along the bight section toward the base section or toward the second section, a gap being defined between the hook-like structure and the bight section or the hook-like structure being in contact with the bight section.

12. The metal leaf spring protection structure of electrical connection terminal as claimed in claim 6, wherein the hook-like structure extends along the bight section toward the base section or toward the second section, a gap being defined between the hook-like structure and the bight section or the hook-like structure being in contact with the bight section.

13. The metal leaf spring protection structure of electrical connection terminal as claimed in claim 1, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

14. The metal leaf spring protection structure of electrical connection terminal as claimed in claim 2, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

15. The metal leaf spring protection structure of electrical connection terminal as claimed in claim 3, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

16. The metal leaf spring protection structure of electrical connection terminal as claimed in claim 4, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

17. The metal leaf spring protection structure of electrical connection terminal as claimed in claim 5, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

18. The metal leaf spring protection structure of electrical connection terminal as claimed in claim 6, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

19. The metal leaf spring protection structure of electrical connection terminal as claimed in claim 7, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

20. The metal leaf spring protection structure of electrical connection terminal as claimed in claim 8, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

21. The metal leaf spring protection structure of electrical connection terminal as claimed in claim 9, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

22. The metal leaf spring protection structure of electrical connection terminal as claimed in claim 10, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

23. The metal leaf spring protection structure of electrical connection terminal as claimed in claim 11, wherein a connection section is disposed between the subsidiary bent section and the locating section of the main body, the connection section obliquely extending in a direction toward the second end of the base section, a reverse bent section being formed between and connected with the connection section and the locating section, an angle contained between the first section and the connection section being an acute angle smaller than an obtuse angle contained by the reverse bent section.

24. The metal leaf spring protection structure of electrical connection terminal as claimed in claim 1, wherein at least the locating section is fixedly parallel to the base section or the head section is formed with a U-shaped structure in a direction away from the base section.

25. The metal leaf spring protection structure of electrical connection terminal as claimed in claim 2, wherein at least the locating section is fixedly parallel to the base section or the head section is formed with a U-shaped structure in a direction away from the base section.

26. The metal leaf spring protection structure of electrical connection terminal as claimed in claim 3, wherein at least the locating section is fixedly parallel to the base section or the head section is formed with a U-shaped structure in a direction away from the base section.

27. The metal leaf spring protection structure of electrical connection terminal as claimed in claim 1, wherein at least the rear end section extends along the second section in contact with the second section or in parallel to the second section.

28. The metal leaf spring protection structure of electrical connection terminal as claimed in claim 2, wherein at least the rear end section extends along the second section in contact with the second section or in parallel to the second section.

29. The metal leaf spring protection structure of electrical connection terminal as claimed in claim 3, wherein at least the rear end section extends along the second section in contact with the second section or in parallel to the second section.

30. The metal leaf spring protection structure of electrical connection terminal as claimed in claim 1, wherein the rear end section is pressed against the tail section or biased toward the tail section.

31. The metal leaf spring protection structure of electrical connection terminal as claimed in claim 2, wherein the rear end section is pressed against the tail section or biased toward the tail section.

32. The metal leaf spring protection structure of electrical connection terminal as claimed in claim 3, wherein the rear end section is pressed against the tail section or biased toward the tail section.

33. The metal leaf spring protection structure of electrical connection terminal as claimed in claim 1, wherein substantially a full length of the rear end section is fixedly contained within a space defined by the bight section.

* * * * *